US008438789B2

(12) United States Patent
Uhl et al.

(10) Patent No.: US 8,438,789 B2
(45) Date of Patent: May 14, 2013

(54) ENERGY EFFICIENT SCUTTLE COVER KITS

(75) Inventors: Fawn M. Uhl, Gahanna, OH (US); Harry Alter, Granville, OH (US); Brandon Robinson, Sylvania, OH (US); Brian P. O'Riordan, Ashville, OH (US); Robert P. Collier, Gahanna, OH (US); Weigang Qi, Westerville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 170 days.

(21) Appl. No.: 12/771,769

(22) Filed: Apr. 30, 2010

(65) Prior Publication Data

US 2011/0265392 A1 Nov. 3, 2011

(51) Int. Cl.
*E04D 13/00* (2006.01)

(52) U.S. Cl.
USPC ..... 52/19

(58) Field of Classification Search ..... 52/19, 3, 52/404.1, 407.3, 407.4, 182
See application file for complete search history.

(56) References Cited

U.S. PATENT DOCUMENTS

| | | | | |
|---|---|---|---|---|
| 4,658,555 | A * | 4/1987 | Steiner | 52/202 |
| 5,623,795 | A * | 4/1997 | Padgett, Jr. | 52/202 |
| 5,792,540 | A * | 8/1998 | Hughes | 428/76 |
| 6,014,841 | A * | 1/2000 | McCoy et al. | 52/19 |
| 6,223,490 | B1 * | 5/2001 | Wessley et al. | 52/404.1 |
| 6,601,352 | B1 * | 8/2003 | Obermeyer et al. | 52/202 |
| 2004/0163345 | A1 * | 8/2004 | Alderman | 52/404.1 |
| 2007/0193136 | A1 * | 8/2007 | Olsen | 52/198 |
| 2009/0133342 | A1 * | 5/2009 | Copeland | 52/202 |
| 2009/0277099 | A1 * | 11/2009 | Ogieglo | 52/19 |

* cited by examiner

*Primary Examiner* — Mark Wendell
*Assistant Examiner* — Keith Minter
(74) *Attorney, Agent, or Firm* — Fraser Clemens Martin & Miller LLC; Charles F. Charpie, III

(57) ABSTRACT

Insulated scuttle covers configured for placement within a building scuttle opening are provided. The insulated scuttle cover includes a scuttle panel configured to cover the building scuttle opening and further configured to be supported when positioned within the building scuttle opening. An insulative assembly is attached to the scuttle panel. The insulative assembly includes insulation material encapsulated by a jacket. The insulated scuttle cover is configured to prevent or substantially retard the flow of air passing through the building scuttle opening.

10 Claims, 7 Drawing Sheets

ENERGY EFFICIENT SCUTTLE COVER KITS

BACKGROUND

The energy efficiency of commercial and residential buildings, such as for example offices, homes and apartments, can be affected by insulating various structures forming the building. Non-limiting examples of structures forming a building include walls and attics.

The energy efficiency of a building can also be affected by insulating structures internal to the building that can be associated with air external to the building. Non-limiting examples these structures include attic scuttles, windows, doors and crawl spaces. It would be advantageous to insulate such structures to conserve energy.

SUMMARY

In accordance with embodiments of this invention there are provided insulated scuttle covers configured for placement within a building scuttle opening. The insulated scuttle cover includes a scuttle panel configured to cover the building scuttle opening and further configured to be supported when positioned within the building scuttle opening. An insulative assembly is attached to the scuttle panel. The insulative assembly includes insulation material encapsulated by a jacket. The insulated scuttle cover is configured to prevent or substantially retard the flow of air passing through the building scuttle opening.

In accordance with other embodiments, there are also provided insulated building scuttle openings. The insulated building scuttle openings include a building scuttle opening and a scuttle panel configured to cover the building scuttle opening. The scuttle panel is further configured to be supported when positioned within the building scuttle opening. An insulative assembly is attached to the scuttle panel and includes insulation material encapsulated by a jacket. A gasket is associated with the scuttle panel and is configured to substantially prevent air from flowing around the edges of the scuttle panel. The insulated scuttle cover is configured to prevent or substantially retard the flow of air passing through the building scuttle opening.

In accordance with other embodiments, there are also provided insulated building scuttle openings. The insulated building scuttle openings include a building scuttle opening and a scuttle panel configured to cover the building scuttle opening. The scuttle panel is further configured to be supported when positioned within the building scuttle opening. An insulative assembly is positioned within the building scuttle opening and is spaced apart from the scuttle panel such as to form a gap between the insulative assembly and the scuttle panel. The insulative assembly includes insulation material encapsulated by a pouch. The scuttle panel and the insulative assembly are configured to prevent or substantially retard the flow of air passing through the building scuttle opening.

In accordance with other embodiments, there are also provided methods of insulating a building scuttle opening. The methods include the steps of providing a scuttle panel configured to cover the building scuttle opening, the scuttle panel further configured to be supported when positioned within the building scuttle opening, attaching an insulative assembly to the scuttle panel thereby forming an insulated scuttle cover, the insulative assembly including insulation encapsulated by a jacket, positioning a gasket within the building scuttle opening in a manner such as to substantially prevent air from flowing around the edges of the scuttle panel and positioning the insulated scuttle cover within the building scuttle opening and in contact with the gasket in a manner such as to prevent or substantially retard the flow of air passing through the building scuttle opening.

In accordance with other embodiments, there are also provided insulated scuttle covers configured for placement within a building scuttle opening. The insulated scuttle cover includes a scuttle panel configured to cover the building scuttle opening and further configured to be supported when positioned within the building scuttle opening. A plurality of form members is attached to the scuttle panel and configured to form a pocket. A top panel is attached to the plurality of form members and configured to enclose the pocket. Insulation material is positioned within the pocket. The insulated scuttle cover is configured to prevent or substantially retard the flow of air passing through the building scuttle opening.

In accordance with other embodiments, there are also provided insulated building scuttle openings. The insulated building scuttle openings include a building scuttle opening and a scuttle panel configured to cover the building scuttle opening. The scuttle panel is further configured to be supported when positioned within the building scuttle opening. An insulative assembly is attached to the scuttle panel, the insulative assembly including a top layer and an intermediate layer attached to insulation material. The insulated scuttle cover is configured to prevent or substantially retard the flow of air passing through the building scuttle opening.

Various advantages of this invention will become apparent to those skilled in the art from the following detailed description of the invention, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, kits for improving the energy efficiency of an attic scuttle are provided. It will be understood the term "kit", as used herein, refers to a collection of items configured for a specific purpose of improving energy efficiency. The term "building", as used herein, is defined to mean any commercial, residential or industrial structure. The term "building structure" as used herein, is defined to mean any assembly or system constructed as part or portion of a building. The term "scuttle", as used herein, is defined to mean a framed opening having a removable cover and configured to provide access to an attic. The term "attic", as used herein, is defined to mean an open space at the top of a house just below roof. The term "batt", as used herein, is defined to mean an elongated blanket of fibrous insulation.

Figure 1:
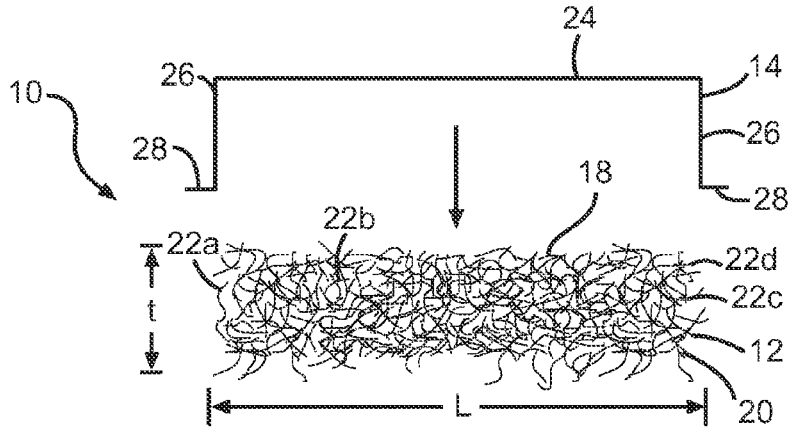
FIG. 1 is an exploded side view, in cross-section, of a first embodiment of an insulative assembly for use with a scuttle opening.
Figure 2:
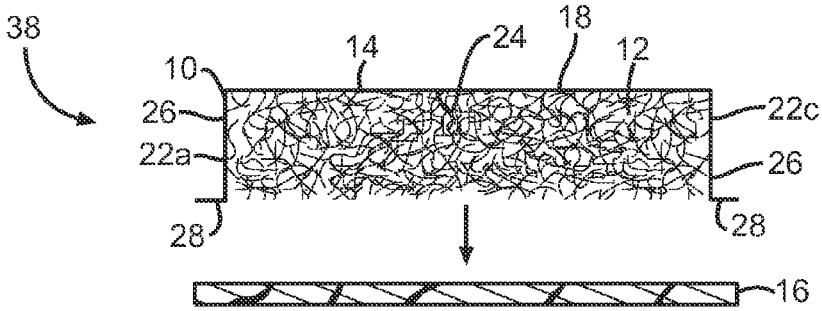
FIG. 2 is an exploded side view, in cross-section, of an insulated scuttle cover.
Figure 3:
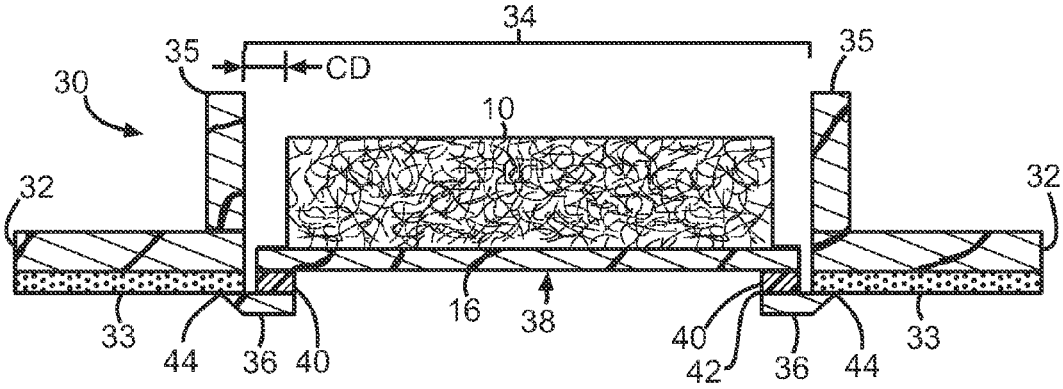
FIG. 3 is a side view, in cross-section, of an insulated scuttle cover positioned in a scuttle opening.

The description and figures disclose energy efficient scuttle cover kits and methods of assembling and installing the scuttle cover kits. The scuttle cover kits are configured to prevent or substantially retard the flow of air passing through the attic scuttle from the interior of the building to the attic or from the attic to the interior of the building. Generally, the kits include insulation, materials to encapsulate the insulation and gasket materials. Referring now to FIGS. 1-3, a first embodiment of an insulative assembly for a scuttle cover kit is illustrated at 10. Referring first to FIG. 1, the insulative assembly 10 includes a batt of insulative material 12 and a jacket 14. As will be explained in more detail below, the batt of insulative material 12 and the jacket 14 will be joined together, thereby forming the insulative assembly 10.

Referring again to the embodiment shown in FIG. 1, the batt of insulative material 12 is made from fiberglass fibers. However, in other embodiments, the batt of insulative material 12 can be made from other insulative fibers, including the non-limiting examples of mineral (rock and slag) wool, polymeric fibers, and natural fibers, such as for example cotton fibers. In still other embodiments, the batt of insulative material 12 can be made from non-fibrous materials, such as the non-limiting example of insulative foam. In the illustrated embodiment, the batt of insulative material 12 has a density in a range from about 0.2 lbs/ft$^3$ (3.2 kg/m$^3$) to about 5.0 lbs/ft$^3$ (80.1 kg/m$^3$) and a thickness t in a range of from about 1.0 inches (2.54 cm) to about 10.0 inches (25.4 cm). The combination of density and thickness t provides an insulative value (R-value) in a range of from about R-11 to about R-38. In other embodiments, the batt of insulative material 12 can have insulative values less than about R-11 or more than R-38 as a result of combinations of densities less than about 0.2 lbs/ft$^3$ (3.2 kg/m$^3$) or more than about 5.0 lbs/ft$^3$ (80.1 kg/m$^3$) and thicknesses less than about 1.0 inches (2.54 cm) or more than about 10.0 inches (25.4 cm). The batt of insulative material 12 can be provided in any desired form, including the non-limiting examples of blankets or rolls having pre-perforated sections.

Referring again to FIG. 1, the batt of insulative material 12 has a length L and a width (not shown). Generally, the length L and the width of the batt of insulative material 12 are sized to correspond to the size of a scuttle panel 16 as shown in FIG. 2. The scuttle panel 16 will be discussed in more detail below. The batt of insulative material 12 has a top surface 18, a bottom surface 20, and side surfaces 22*a*-22*d*.

Referring again to FIG. 1, the jacket 14 is attached to the batt of insulative material 12, thereby forming the insulative assembly 10. The insulative assembly 10 is attached to the scuttle panel 16, thereby encapsulating the batt of insulative material 12 within the jacket 14. The jacket 14 can be formed from various materials. In one embodiment, the jacket 14 can be formed from a continuous polymeric material having a plurality of perforations. Non-limiting examples of the polymeric material include polyethylene and polypropylene. However, other polymeric materials can be used. The jacket 14 can also be formed as a fibrous web of non-woven fibers, such as for example, fiberglass fibers or polymeric fibers. As shown in FIG. 1, the jacket 14 has a top panel 24, sidewalls 26 and optional flaps 28. As further shown in FIG. 1, the optional flaps 28 extend from the sidewalls 26 of the jacket 14.

Referring now to FIG. 2, the batt of insulative material 12 and the jacket 14 have been joined together to form the insulative assembly 10. The batt of insulative material 12 and the jacket 14 are joined in a manner such that the top panel 24 and sidewalls 26 of the jacket 14 contact the top surface 18 and side surfaces 22*a*-22*d* of the batt of insulative material 12. In the illustrated embodiment, the batt of insulative material 12 and the jacket 14 are joined together by a heat sealing process. However, in other embodiments, the batt of insulative material 12 and the jacket 14 can be joined together by other desired manufacturing processes, including the non-limiting example of using adhesives. After the batt of insulative material 12 and the jacket 14 are joined together, the optional flaps 28 of the jacket 14 remain in an extended position. As will be explained in more detail below, the insulative assembly 10 is attached to the scuttle panel 16, thereby forming an insulated scuttle cover 38.

Referring now to FIG. 3, a building scuttle 30 is illustrated. The building scuttle 30 is positioned among horizontally oriented ceiling joists 32 and ceiling materials 33 attached to the ceiling joists 32. In the illustrated embodiment, the ceiling joists 32 are framing members made from wood. However, in other embodiments, the ceiling joists 32 can be other desired framing members, including the non-limiting examples of steel studs or wood lathe. In the illustrated embodiment, the ceiling materials 33 are drywall panels. Alternatively, the ceiling materials 33 can be other materials including the non-limiting examples of plaster or tiles.

Referring again to FIG. 3, a plurality of framing members 35 are arranged in a manner such as to define an opening 34. In the illustrated embodiment, the framing members 35 are made from wood. However, in other embodiments, the framing members 35 can be other desired framing members, including the non-limiting examples of steel studs or wood lathe. The opening 34 can have any desired dimensions.

As shown in FIG. 3, a plurality of trim members 36 extend from the ceiling materials 33 into the opening 34 and are configured to provide support to the insulative assembly 10. In the illustrated embodiment, the trim members 36 are made of wood. In other embodiments, the trim members 36 can be made of other materials, such as for example, polymeric materials. Optionally, the trim members 36 can have any desired decorative finish.

Optionally, a sealant or caulk 44 can be positioned between the trim members 36 and the ceiling materials 33. The sealant 44 is configured to substantially prevent air from flowing around the edges of the trim members 36. In the illustrated embodiment, the sealant 44 is made of a silicone acrylic material. In other embodiments, the sealant 44 can be made of other desired materials, sufficient to substantially prevent air from flowing around the edges of the trim members 36. The sealant 44 can have any desired thickness.

Referring again to FIG. 3, the insulated scuttle cover 38 is sized to fit within the opening 34 of the building scuttle 30 and further configured to be supported by the trim members 36. In the illustrated embodiment, the insulated scuttle cover 38 forms a clearance dimension CD with the framing members 35. The clearance dimension CD is in a range of from about 0.25 inches to about 2.00 inches. In other embodiments, the clearance dimension CD can be less than about 0.25 inches or more than about 2.00 inches. In still other embodiments, the insulated scuttle cover 38 can be sized such as to provide no clearance with the framing members 35. In this embodiment, the insulated scuttle cover 38 is configured to form a friction fit with the framing members 35, thereby substantially assisting in preventing or retarding the flow of air passing through the attic scuttle from the interior of the building to the attic or from the attic to the interior of the building.

Referring again to FIG. 2, the insulative assembly 10 is attached to the scuttle panel 16 such that the optional flaps 28 of the insulative assembly 10 are secured to the scuttle panel 16. In the illustrated embodiment, the flaps 28 are secured to the scuttle panel 16 by stapling. In other embodiments, the flaps 28 can be secured to the scuttle panel 16 by other desired methods, including the non-limiting example of using adhesives. While the insulative assembly 10 shown in FIG. 2 provides for the optional flaps 28, it should be appreciated that the insulative assembly 10 can be secured to the scuttle panel 16 without the optional flaps 28. As discussed above, attaching the insulative assembly 10 to the scuttle panel 16 forms an insulated scuttle cover 38.

Referring again to FIG. 3, prior to positioning the insulated scuttle cover 38 over the trim members 36, a gasket 40 is positioned on a top surface 42 of the trim members 36, thereby forming a perimeter within the opening 34. The gasket 40 is configured to substantially prevent air from flowing around the edges of the insulated scuttle cover 38. In the illustrated embodiment, the gasket 40 is made of an expanded, flexible, polymeric material, such as for example polyurethane foam. In other embodiments, the gasket 40 can be made of other materials, including the non-limiting example of felt, sufficient to substantially prevent air from flowing around the edges of the insulated scuttle cover 38. The gasket 40 can have any desired thickness. While the illustrated embodiment has been described as having the gasket 40 installed on the trim members 36, it should be appreciated that in other embodiments the gasket 40 can be installed on the bottom of the scuttle panel 16.

As shown in FIG. 3, the insulated scuttle cover 38 is positioned on the gasket 40. In this position, the insulated scuttle cover 38 is configured to prevent or substantially retard the flow of air passing through the attic scuttle 30 from the interior of the building to the attic or from the attic to the interior of the building. The insulated scuttle cover 38 can be removed simply by raising the insulated scuttle cover 38 from the trim members 36.

Referring again to FIG. 1, in another embodiment of the insulative assembly 10, the jacket 14 can be made of a reflective material, such as for example foil. The reflective material used for the jacket 14 is configured to provide additional insulative properties to the insulative assembly 10. The reflective material can be attached to the batt of insulative material 12 in the same manner as described above and the resulting insulative assembly 10 having the reflective jacket 14 can be attached to the scuttle panel 16 in the same manner as discussed above. The insulative assembly 10 is positioned in the building scuttle 30 as discussed above and shown in FIG. 3.

Figure 4A:
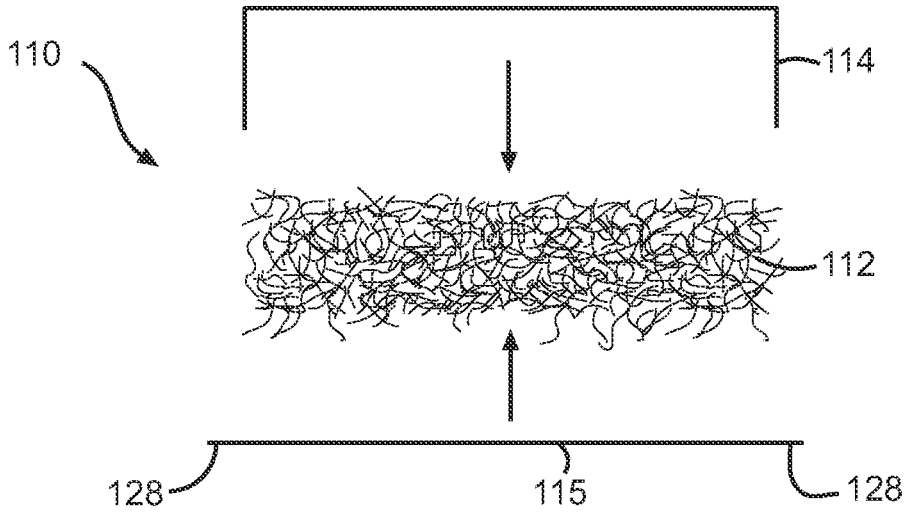
FIG. 4A is an exploded side view, in cross-section, of another embodiment of an insulative assembly for use with a scuttle opening.
Figure 4B:
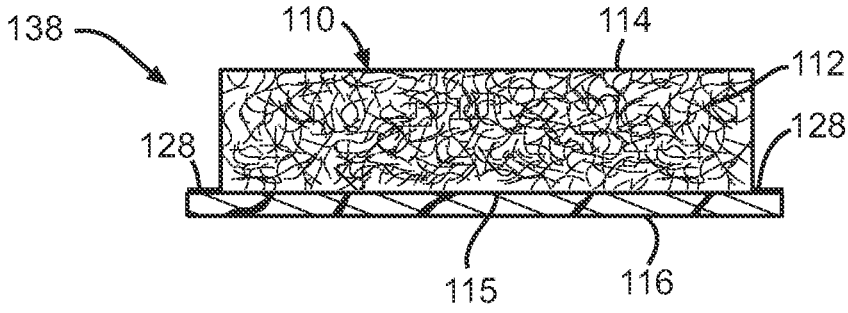
FIG. 4B is a side view, in cross-section, of the insulative assembly of FIG. 4 attached to a scuttle panel to form an insulated scuttle cover.

Another embodiment of an insulative assembly 110 is illustrated in FIGS. 4A and 4B. The insulative assembly 110 includes a batt of insulative material 112, a jacket 114 and an intermediate layer 115. In the illustrated embodiment, the batt of insulative material 112 is the same as, or similar to, the batt of insulative material 12 discussed above and shown in FIG. 1. In other embodiments, the batt of insulative material 112 can be different from the batt of insulative material 12.

Referring again to the embodiment illustrated in FIG. 4A, the jacket 114 is the same as, or similar to, the jacket 14 discussed above and shown in FIG. 1 with the exceptions that the jacket 114 is made of reflective material and the jacket 114 does not include the optional flaps 28. In other embodiments, the jacket 114 can be different from the jacket 14.

Referring again to the embodiment illustrated in FIG. 4A, the intermediate layer 115 is made of a reflective material, such as for example foil. However, in other embodiments, the intermediate layer 115 can be made from other desired materials. The reflective material used for the intermediate layer 115 is configured to provide additional insulative properties to the insulative assembly 110. The intermediate layer 115 includes optional flaps 128 extending from the intermediate layer 115.

The insulative assembly 110 is assembled by attaching the batt of insulative material 112 to the jacket 114 in the same manner as discussed above. The intermediate layer 115 can be attached to the batt of insulative material 112 in the same manner as the jacket 114 is attached to the batt of insulative material 112. Attaching the jacket 114 and the intermediate layer 115 to the batt of insulative material 112 forms the insulative assembly 110.

Referring now to FIG. 4B, the insulative assembly 110 can be attached to the scuttle panel 116 in the same manner as discussed above. Attaching the insulative assembly 110 to the scuttle panel 116 forms an insulated scuttle cover 138. The insulated scuttle cover 138 can be positioned in an opening of a building scuttle in the same manner as shown in FIG. 3 and as discussed above.

Figure 5A:
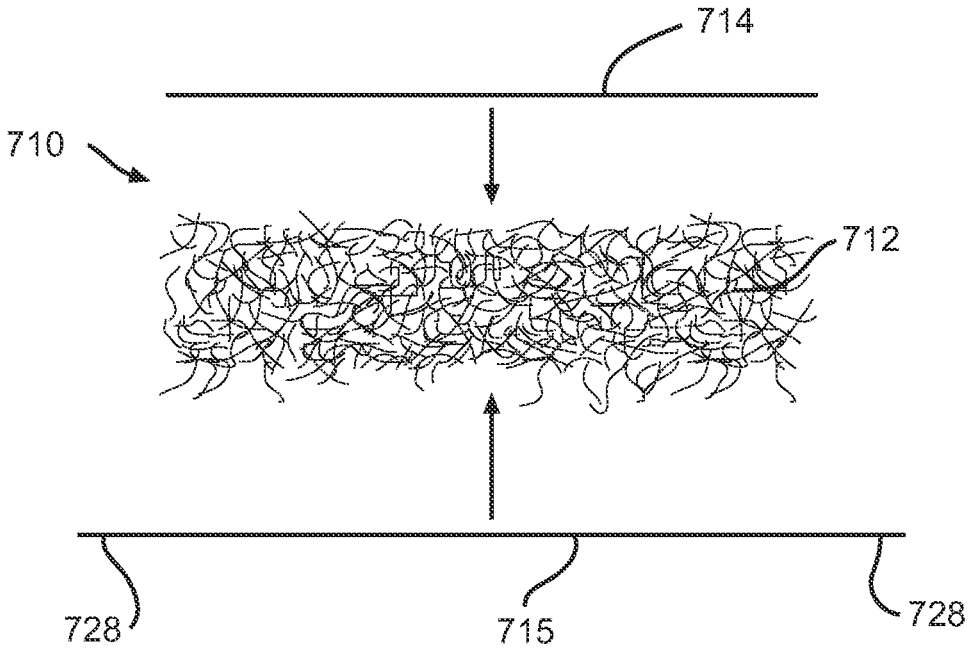
FIG. 5A is an exploded side view, in cross-section, of another embodiment of an insulative assembly for use with a scuttle opening.
Figure 5B:
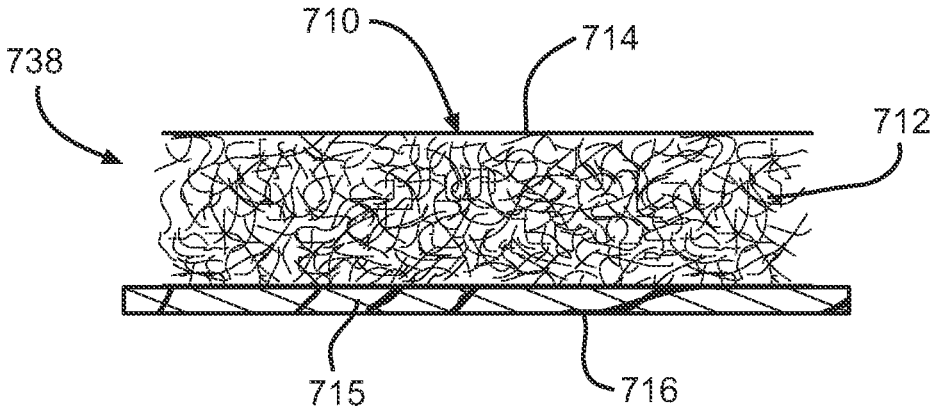
FIG. 5B is a side view, in cross-section, of the insulative assembly of FIG. 5A attached to a scuttle panel to form an insulated scuttle cover.

Another embodiment of an insulative assembly 710 is illustrated in FIGS. 5A and 5B. The insulative assembly 710 includes a batt of insulative material 712, a top layer 714 and an intermediate layer 715. In the illustrated embodiment, the batt of insulative material 712 is the same as, or similar to, the batt of insulative material 12 discussed above and shown in FIG. 1. In other embodiments, the batt of insulative material 712 can be different from the batt of insulative material 12.

Referring again to the embodiment illustrated in FIG. 5A, the top layer 714 and the intermediate layer 715 are the same as, or similar to, the intermediate layer 115 discussed above and illustrated in FIG. 4A. However, in other embodiments, the top layer 714 and the intermediate layer 715 can be made from other desired materials. The reflective material used for the top layer 714 and the intermediate layer 715 is configured to provide additional insulative properties to the insulative assembly 710. In the embodiment illustrated in FIGS. 5A and 5B, the insulative assembly 710 does not include sidewalls 26 as discussed above and shown in FIG. 1. Alternatively, the insulative assembly 710 can include sidewalls. The intermediate layer 715 includes optional flaps 728 extending from the intermediate layer 715.

The insulative assembly 710 can be assembled by attaching the batt of insulative material 712 to the top layer 714 and the intermediate layer 715 in the same manner as discussed above. However, the top layer 714 and the intermediate layer 715 can be attached to the batt of insulative material 712 in other desired manners. Attaching the top layer 714 and the intermediate layer 715 to the batt of insulative material 712 forms the insulative assembly 710.

Referring now to FIG. 5B, the insulative assembly 710 can be attached to the scuttle panel 716 in the same manner as discussed above. Attaching the insulative assembly 710 to the scuttle panel 716 forms an insulated scuttle cover 738. The insulated scuttle cover 738 can be positioned in an opening of a building scuttle in the same manner as shown in FIG. 3 and as discussed above.

Figure 6:
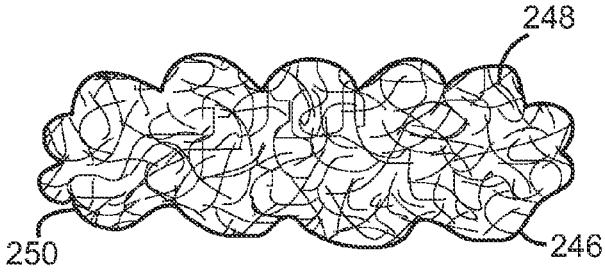
FIG. 6 is a side view, in cross-section, of an insulated pouch for use with a scuttle opening.
Figure 7:
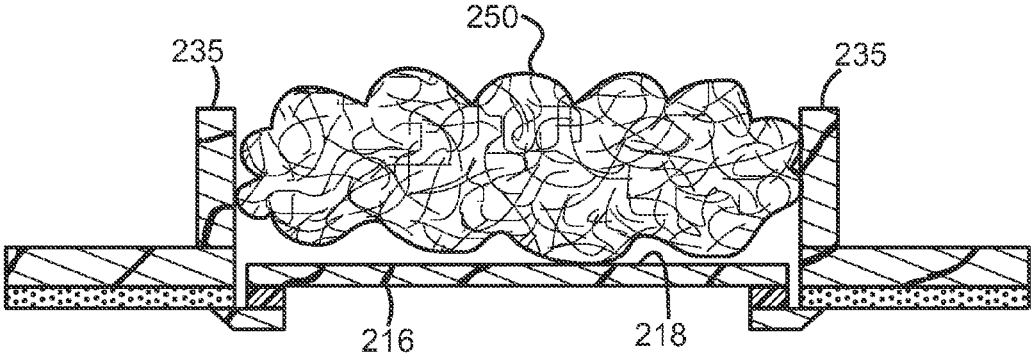
FIG. 7 is a side view, in cross-section, of the insulated pouch of FIG. 6 positioned in a scuttle opening.

Referring now to FIGS. 6 and 7, another embodiment of an insulated scuttle opening is illustrated. Referring first to FIG. 6, a pouch 246 is filled with loosefill insulation 248 to form an insulated pouch 250. Referring now to FIG. 7, the insulated pouch 250 is then positioned above a scuttle panel 216 and between framing members 235. The insulated pouch 250 is sized to be wide enough in a horizontal direction that positioning the insulated pouch 250 between the framing members 235 results in a friction fit between the insulated pouch 250 and the framing members 235. The term "friction fit", as used herein, is defined to mean the fastening between two parts which is achieved by friction after the parts are pushed together, rather than by any other means of fastening.

Referring again to FIG. 6, the pouch 246 can be formed from various materials. In one embodiment, the pouch 246 can be formed from a continuous polymeric material having a plurality of perforations. Non-limiting examples of the polymeric material include polyethylene and polypropylene. However, other polymeric materials can be used. The pouch 246 can also be formed as a fibrous web of non-woven fibers, such as for example, fiberglass fibers.

Referring again to FIG. 6, the loosefill insulation 248 can be any desired loosefill insulation, such as a multiplicity of discrete, individual tuffs, cubes, flakes, or nodules. The loosefill insulation 248 can be made of glass fibers or other mineral fibers, and can also be polymeric fibers, organic fibers or cellulose fibers. The loosefill insulation 248 can have a binder material applied to it, or it can be binderless.

In operation, the pouch 246 can be filled with the loosefill insulation 248 in any desired manner, including the non-limiting examples of pouring the loosefill insulation 248 into the pouch 246 or entraining the loosefill insulation 248 in an airstream and blowing the loosefill insulation 248 into the pouch 246. The pouch 246 is filled with loosefill insulation 248 until the pouch 246 reaches a desired vertical height. The vertical height of the filled pouch 246, combined with the insulative value of the loosefill insulation 248 provides a desired insulative value of the insulated pouch 250.

The pouch 246, filled with the loosefill insulation 248, is closed and sealed. The pouch 246 can be sealed in any desired manner including the non-limiting examples of heat sealing or using adhesives.

Referring now to FIG. 7 and as discussed above, the insulated pouch 250 is positioned above the scuttle panel 216 and between the framing members 235. In the illustrated embodiment, the insulated pouch 250 is positioned above the scuttle panel 216 such that portions of the insulated pouch 250 are in contact with a top surface 218 of the scuttle panel 216. In other embodiments, the insulated pouch 250 can be positioned above the scuttle panel 216 such a gap (not shown) is created between the insulated pouch 250 and the top surface 218 of the scuttle panel 216. The gap can be any desired size. In yet other embodiments, the insulated pouch 250 can be adhered to the scuttle panel 216.

Figure 8:
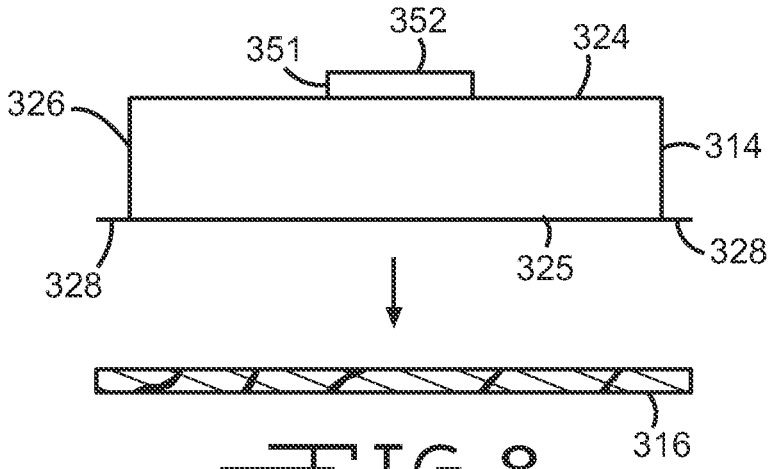
FIG. 8 is an exploded side view, partially in cross-section, of another embodiment of an insulated scuttle cover.
Figure 9:
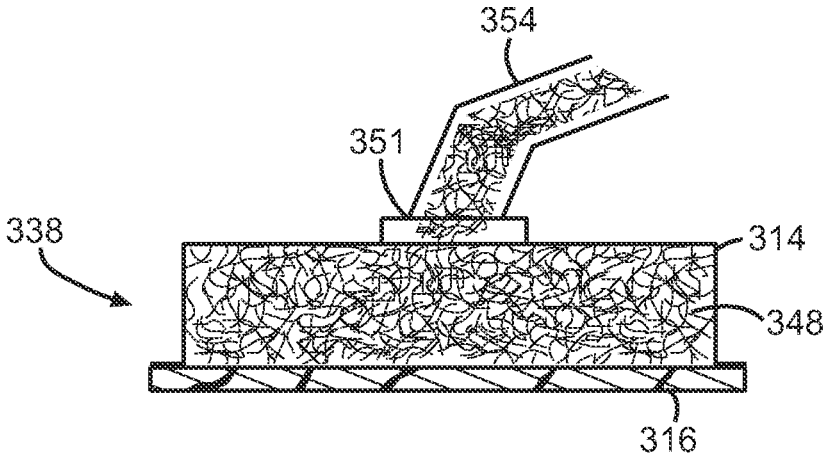
FIG. 9 is a side view, in cross-section, of the insulated scuttle cover of FIG. 8, illustrating the insertion of loosefill insulation.

Referring now to FIGS. 8-9, another embodiment of an insulated scuttle cover is illustrated. In this embodiment, a bag 314 is attached to a scuttle panel 316 and the bag 314 is subsequently filled with insulation material 348. The scuttle panel 316 having the attached bag 314 filled with the insulation material 348 forms an insulated scuttle cover 338. In this embodiment, the scuttle panel 316 is the same as, or similar to, the scuttle panel 16 described above and illustrated in FIG. 2. Alternatively, the scuttle panel 316 can be different from the scuttle panel 16. Also, in this embodiment, the insulation material 348 is the same as, or similar to, the loosefill insulation 248 described above and illustrated in FIG. 6. Alternatively, the insulation material 348 can be other forms of insulation, including the non-limiting example of batts of fibrous insulation.

Referring now to FIG. 8, the bag 314 includes a top panel 324, a bottom panel 325 and sidewalls 326. The bottom panel 325 includes optional flaps 328 extending from the bag 314. In the illustrated embodiment, the bag 314 can be made of the same materials as the pouch 246 discussed above and illustrated in FIG. 6. In other embodiments, the bag 314 can be made of different materials than the pouch 246. In the illustrated embodiment, the optional flaps 328 are the same as, or similar to, the optional flaps 28 discussed above and illustrated in FIG. 1. In other embodiments, the flaps 328 can be different from the flaps 28.

Figure 10:
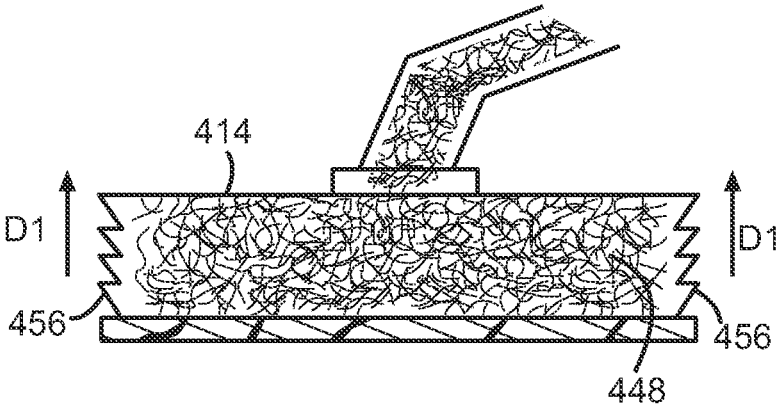
FIG. 10 is an exploded side view, in cross-section, of another embodiment of an insulated scuttle cover illustrating a bellows style bag having folded segments.

As shown in FIG. 8, the top panel 324, bottom panel 325 and sidewalls 326 of the bag 314 can cooperate to give the bag 314 a formed cross-sectional shape prior to the insertion of the loosefill insulation 348 into the bag 314. In the illustrated embodiment, the cross-sectional shape is a rectangle. In other embodiments, the bag 314 can have other cross-sectional shapes, such as for example a formless cross-sectional shape. In still other embodiments as shown in FIG. 10, the bag 414 can have a bellows-style form including folded segments 456 configured to expand in the direction indicated by the arrow D1 from a substantially flat cross-sectional shape to an expanded cross-sectional shape as the loosefill insulation 448 is inserted into the bag 414.

Referring again to FIG. 8, the bag 314 includes an opening 351 positioned on the top panel 324 of the bag 314 and a closing structure 352. The closing structure 352 is configured to close the opening 351 in the bag 314 after the bag 314 is filled with the loosefill insulation 348. In the illustrated embodiment, the closing structure 352 is a zipper. Alternatively, the closing structure 352 can be other structures, devices or mechanisms configured to close the opening 351 in the bag 314 after the bag 314 is filled with the loosefill insulation 348, such as for example, a Ziploc® structure. In still other embodiments, the closing structure 352 can be other structures, such as for example a flap (not shown) configured to cover the opening 351 and substantially prevent the loosefill insulation 348 from exiting the opening 351.

While the embodiment illustrated in FIGS. 8 and 9 illustrate the opening 351 and the closing structure 352 as being positioned on the top panel 324 of the bag 314, it should be appreciated that the opening 351 and the closing structure 352 can be positioned in other locations of the bag 314, including the non-limiting example of a sidewalls 326 of the bag 314.

In the embodiment as shown in FIG. 8, the bag 314 is attached to the scuttle panel 316 in the same manner as the jacket 14 was attached to the scuttle panel 16 as shown in FIG. 2 and described above. However, it should be appreciated that the bag 314 can be attached to the scuttle panel 316 in other manners, including the non-limiting example of stapling the bottom panel 325 of the bag 314 to the scuttle panel 316.

In the illustrated embodiment, the bag 314 is filled with loosefill insulation 348 as a distribution hose 354, having air entrained with the loosefill insulation 348, is inserted into the opening 351. In other embodiments, the bag 314 can be filled with loosefill insulation 348 in other desired manners, including the non-limiting example of pouring the loosefill insulation 348 into the bag 314. The bag 314 is filled with a desired quantity of loosefill insulation 348. As discussed above, the quantity of loosefill insulation within the bag 314 is a factor in determining the insulative value (R-value) of the insulated scuttle cover 338. After the bag 314 receives the desired quantity of loosefill insulation 348, the closing structure 352 is closed and the insulated scuttle cover 338 is positioned in the scuttle opening as previously described.

Figure 11:
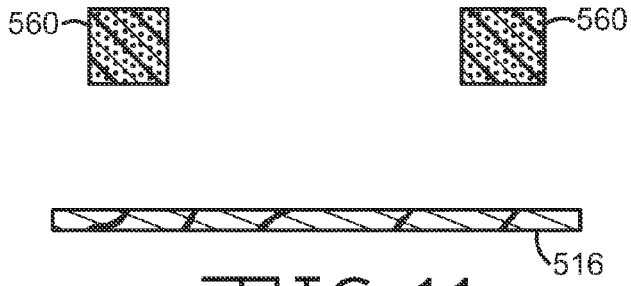
FIG. 11 is an exploded side view, in cross-section of a portion of another embodiment of a scuttle panel.
Figure 12:
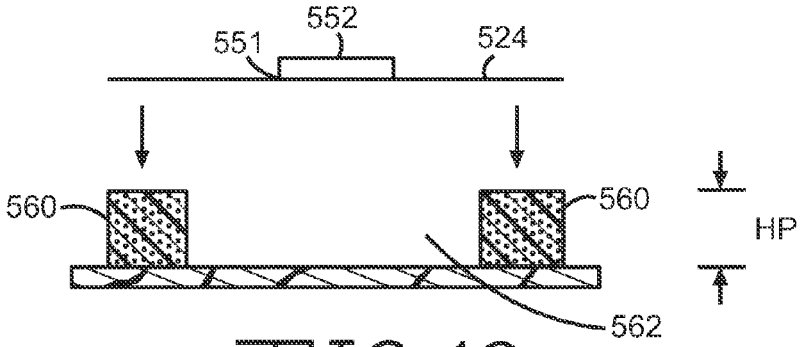
FIG. 12 is an exploded side view, in cross-section, of the scuttle panel of FIG. 11 and a top panel having a closing structure.
Figure 13:
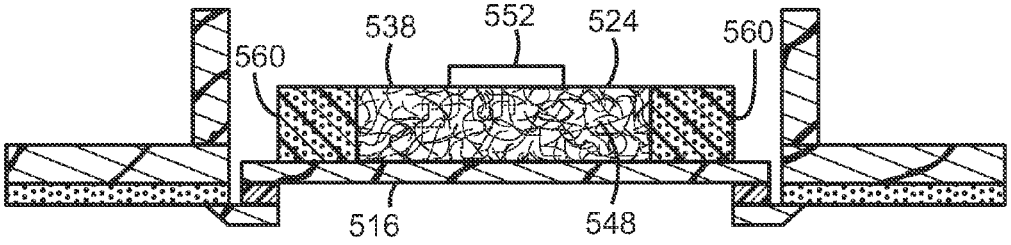
FIG. 13 is a side view, in cross-section of an insulated scuttle cover illustrated in a scuttle opening.

Referring now to FIGS. 11-13, another embodiment of an insulative assembly is illustrated. In this embodiment, a pocket is created using a scuttle panel 516 and other members. The pocket is subsequently filled with loosefill insulation and an insulated scuttle cover 538 is formed.

Referring now to FIG. 11, a scuttle panel 516 is illustrated. In the illustrated embodiment, the scuttle panel 516 is the same as, or similar to, the scuttle panel 16 discussed above and illustrated in FIG. 2. In other embodiments, the scuttle panel 516 can be different from the scuttle panel 16. A plurality of form members 560 are attached to the scuttle panel 516 in a manner such as to form a pocket 562 as shown in FIG. 12. In the illustrated embodiment, the form members 560 are made of a rigid-foam material. Alternatively, the form members 560 can be made of other materials, such as for example wood, sufficient to form a pocket 562. The form members 560 can be attached to the scuttle panel 516 in any desired manner, including the non-limiting example of an adhesive.

Referring now to FIG. 12, a top panel 524 spans the pocket 562 and is attached to the form members 560. The top panel 524 is configured to enclose the pocket 562. The pocket 562 is subsequently filled with loosefill insulation 548. The top panel 524 can be made of the same materials as the pouch 246 discussed above and illustrated in FIG. 6. Alternatively, the top panel 524 can be made of different materials than the pouch 246. The top panel 524 can be attached to the form members 560 in any desired manner, including the non-limiting method of using adhesives.

Referring again to FIG. 12, the top panel 524 includes an opening 551 and a closing structure 552. In the illustrated embodiment, the opening 551 and the closing structure 552 are the same as, or similar to, the opening 351 and the closing structure 352 discussed above and illustrated in FIG. 8. In other embodiments the opening 551 and the closing structure 552 can be different from the opening 351 and the closing structure 352. Subsequent to enclosing the pocket 562 by attaching the top panel 524 to the forming members 560, the pocket 562 is filled with loosefill insulation 548 as shown in FIG. 13. In the illustrated embodiment, the loosefill insulation 548 is the same as, or similar to, the loosefill insulation 348 discussed above and illustrated in FIG. 9. However, in other embodiments the loosefill insulation 548 can be different from the loosefill insulation 348. The loosefill insulation 548 can be inserted into the pocket 562 in any desired manner including the method described above for the loosefill insulation 348. Inserting the loosefill insulation 548 into the pocket 562 forms an insulated scuttle cover 538.

Referring again to FIG. 12, the pocket 562 has a height HP. The height HP of the pocket 562 and the density of the loosefill insulation combine to determine the maximum quantity of loosefill insulation 548 that can be inserted into the pocket 562. Accordingly, the height HP of the pocket 562 is a factor in determining the insulative value of the insulated scuttle cover 538. The height HP of the pocket 562 can be any desired dimension.

Figure 14:
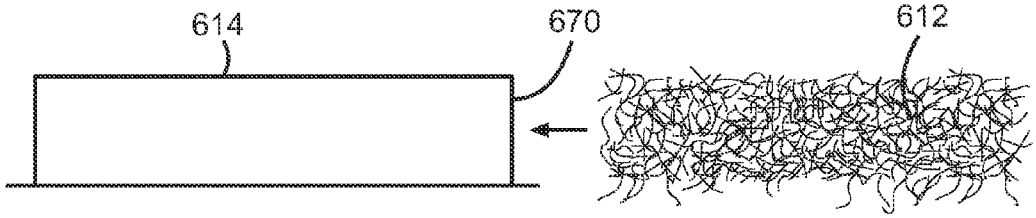
FIG. 14 is a side view, in elevation, of another embodiment of a bag filled with a batt of insulative material.
Figure 15:
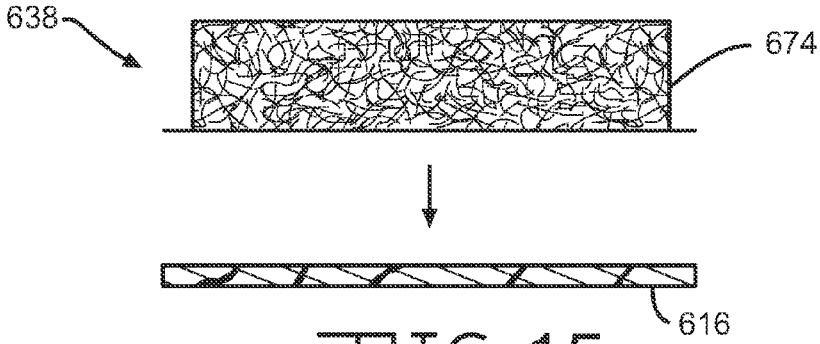
FIG. 15 is a side view, in cross-section, of the bag and batt of insulative material of FIG. 14 being attached to a scuttle panel to form an insulated scuttle cover.

Referring now to FIGS. 14 and 15, another embodiment of an insulated scuttle cover 638 is illustrated. Generally, the insulated scuttle cover 638 is formed by attaching a bag 614 filled with a batt of insulative material 612 to a scuttle panel 616. In the illustrated embodiment, the bag 614 is the same as, or similar to, the bag 314 discussed above and illustrated in FIG. 8 with the exception that the bag 614 optionally includes a closing structure (not shown). Alternatively, in other embodiments, the bag 614 can be different from the bag 314.

Referring now to FIG. 14, the bag 614 includes an opening 670 configured to receive the batt of insulative material 612. In some embodiments, the opening 670 is enclosed by the optional closing structure and in other embodiments, the opening 670 is not enclosed subsequent to the insertion of the batt of insulative material 612 into the bag 614.

Referring again to FIG. 14, the batt of insulative material 612 is the same as, or similar to, the batt of insulative material 112 described above and illustrated in FIG. 4. However, the batt of insulative material 612 can be different from the batt of insulative material 112. Inserting the batt of insulative material 612 into the bag 614 forms insulated bag 674.

In the embodiment as shown in FIG. 15, the insulated bag 674 is attached to the scuttle panel 616 in the same manner as the jacket 14 was attached to the scuttle panel 16 as shown in FIG. 2 and described above. However, it should be appreciated that the insulated bag 674 can be attached to the scuttle panel 616 in other desired manners. Attaching the insulated bag 674 to the scuttle panel 616 forms insulated scuttle cover 638. The insulated scuttle cover 638 can be installed into the scuttle opening as previously described.

The principle and mode of operation of the energy efficient scuttle cover kits have been described in certain embodiments. However, it should be noted that the energy efficient scuttle cover kits may be practiced otherwise than as specifically illustrated and described without departing from its scope.

What is claimed is:

1. An insulated scuttle cover configured for placement within a building scuttle opening, the insulated scuttle cover comprising:

a scuttle panel configured to cover the building scuttle opening, the scuttle panel further configured to be supported when positioned within the building scuttle opening; and an insulative assembly attached to the scuttle panel, the insulative assembly including insulation material thermally bonded to a jacket such that the jacket and the scuttle panel encapsulate the insulation material and such that the insulation material is positioned on the attic side of the scuttle panel;

wherein the insulated scuttle cover is configured to prevent or retard the flow of air passing through the building scuttle opening.

2. The insulated scuttle cover of claim 1, wherein the insulation material is a batt of fibrous insulation.

3. The insulated scuttle cover of claim 1, wherein the jacket is made of a polymeric material.

4. The insulated scuttle cover of claim 3, wherein the jacket includes perforations.

5. The insulated scuttle cover of claim 1, wherein a gasket is installed on a bottom of the insulated scuttle cover.

6. The insulated scuttle cover of claim 1, wherein in an installed position, the insulated scuttle cover is configured to form a friction fit with framing members forming the building scuttle opening.

7. The insulated scuttle cover of claim 1, wherein the jacket is made of a reflective material.

8. An insulated building scuttle opening comprising:

a building scuttle opening;

a scuttle panel configured to cover the building scuttle opening, the scuttle panel further configured to be supported when positioned within the building scuttle opening;

an insulative assembly attached to the scuttle panel, the insulative assembly including insulation material thermally bonded to a jacket such that the jacket and the scuttle panel encapsulate the insulation material and such that the insulation material is positioned on the attic side of the scuttle panel; and a gasket associated with the scuttle panel and configured to retard air from flowing around the edges of the scuttle panel;

wherein the insulated scuttle cover is configured to prevent or retard the flow of air passing through the building scuttle opening.

9. The insulated scuttle cover of claim 8, wherein the insulation material is a batt of fibrous insulation.

10. The insulated building scuttle opening of claim 8, wherein the jacket is made of a reflective material.

* * * * *